United States Patent [19]

de Kroon

[11] Patent Number: 4,510,743

[45] Date of Patent: Apr. 16, 1985

[54] ROPE COMPRISING TWO OR MORE POLYMER COMPONENTS

[75] Inventor: Jan de Kroon, Wijk bij Duurstede, Netherlands

[73] Assignee: Akzo N.V., Arnhem, Netherlands

[21] Appl. No.: 394,657

[22] Filed: Jul. 2, 1982

Related U.S. Application Data

[63] Continuation of Ser. No. 128,090, Mar. 7, 1980, abandoned, which is a continuation of Ser. No. 851,769, Nov. 15, 1977, abandoned.

[30] Foreign Application Priority Data

Nov. 26, 1976 [NL] Netherlands ..... 7613193

[51] Int. Cl.[3] ..... D02G 3/02; D02G 3/22

[52] U.S. Cl. ..... 57/260; 57/235; 57/238; 57/244; 57/907; 428/364; 428/370; 428/371; 428/401

[58] Field of Search ..... 428/401, 364, 370, 371; 264/210 F, 176 F; 57/31, 230, 231, 235, 260, 244, 907, 238

[56] References Cited

U.S. PATENT DOCUMENTS

| | | | |
|---|---|---|---|
| 3,164,947 | 11/1965 | Gaston | 428/401 |
| 3,223,752 | 12/1965 | Tate | 525/172 |
| 3,242,035 | 3/1966 | White | 428/401 |
| 3,382,305 | 5/1968 | Breen | 428/401 |
| 3,419,638 | 12/1968 | Fuzek | 525/174 |
| 3,471,604 | 10/1969 | Butler | 264/156 |
| 3,604,196 | 9/1971 | Prevorsek | 57/260 |
| 3,695,025 | 10/1972 | Gibbon | 57/31 |
| 3,707,837 | 1/1973 | Gibbon | 57/31 |
| 4,036,003 | 7/1977 | Lowder | 57/907 |

FOREIGN PATENT DOCUMENTS

| | | | |
|---|---|---|---|
| 1054303 | 1/1967 | United Kingdom | 428/401 |

*Primary Examiner*—Ellis P. Robinson
*Attorney, Agent, or Firm*—Stevens, Davis, Miller & Mosher

[57] ABSTRACT

A composite elongated-shaped product is made from two or more synthetic polymer components. The product may be a split-fiber, thread, film or a ribbon-shaped one. One of the polymer components is polypropylene which forms more than 50 percent by weight of the product. At least one other polymer component is distributed in the polypropylene. The composite product contains 65 to 95 percent by weight of polypropylene and 35 to 5 percent by weight of one or more polyesters and/or polyamides. The polyesters are built up of structural units derived from one or more dicarboxylic acids, at least 70 mole % of which are from terephthalic acid. Other structural units are derived from one or more low-molecular weight diols, at least 70 mole % of which are from a diol having the formula $HO(CH_2)_nOH$, where n is a whole number and may be 2, 4 or 6. The polyamides are formed by polycondensation of caprolactam or adipic acid and hexamethylene-1,6-diamine. The polyester or polyamides are partly present in the form of fibrils. The tensile strength Y of the oriented composite product is at least equal to $Y=1.1X$, where X is the tensile strength of a corresponding elongated-shaped product which is a practically 100% polypropylene product having a melt index of 3 and was made in the same way as the composite elongated-shaped product, X being greater than or equal to 45 cN/tex in the case where the product is formed by split-fiber and X being greater than or equal to 35 cN/tex for ribbon or film-shaped products, i.e. in the case where the product is not formed of split-fibers, the value of X being greater than or equal to 50 cN/tex for thread-shaped products such as monofilaments.

4 Claims, 2 Drawing Figures

ROPE COMPRISING TWO OR MORE POLYMER COMPONENTS

This is a continuation of application Ser. No. 128,090 filed Mar. 7, 1980 now abandoned which in turn is a continuation of application Ser. No. 851,769, filed Nov. 15, 1977, now abandoned.

This invention relates to a composite enlongated-shaped product made up of two or more synthetic polymer components, and more particularly to a split-fiber, thread, film- or ribbon-shaped product, in which one of the polymer components is of polypropylene which forms more than 50 percent by weight of the product, and one or more other polymer components are distributed in the polypropylene.

The invention also provides a process for the manufacture of such a product.

A composite product of the type indicated above may be considered to be more or less known from British Patent Specification No. 1,054,303 and U.S. Pat. No. 3,419,638. It has often been the practice for such a composite product to be prepared from different polymers distributed one within the other for the purpose of improving the dyeability of the polypropylene. On the basis of experiments it had been found that the tensile strength of such a composite product from two polymers such as polypropylene and polyethylene terephthalate, which are insoluble one within the other or at least poorly compatible, is distinctly lower than was to be expected on the basis of a linear relationship from the ratio of the weight percentages of the two components.

Surprisingly, a composite product of the type indicated above has been found which is characterized in that the composite product contains 65 to 95 percent by weight of polypropylene and 35 to 5 percent by weight of one or more polyesters and/or polyamides, which polyesters are made up of structural units derived from one or more dicarboxylic acids, at least 70 mole per cent of which consists of terephthalic acid, and of structural units derived from one or more low-molecular diols, at least 70 mole % of which consists of a diol having the formula $HO(CH_2)_nOH$, wherein n represents a whole number and may be 2, 4 or 6, and which polyamides are formed by polycondensation of caprolactam or adipic acid and hexamethylene-1,6-diamine, which are to a great extent present in the form or fibrils, and in that the tensile strength Y of the oriented composite product is at least equal to $Y=1.10X$, where X is the tensile strength of a corresponding elongated-shaped product which is a substantially 100%-polypropylene product having a melt index of 3 and is made in the same way as the composite elongated shaped product, X being greater than or equal to 45 cN/tex in the case where the product is formed of split-fibers, the value of X being greater than or equal to 35 Cn/tex for ribbon or film-shaped products in the case where the product is not formed of split-fibers, the value of X being greater than or equal to 50 cN/tex for thread-shaped products such as monofilaments.

It has even been found that the tensile strength Y of the composite product according to the invention has a value between $Y=1.20X$ and $Y=1.60X$ and not higher than $Y=2X$. Unaccountably as yet and entirely unexpectedly, the composite product according to the invention therefore has a tenacity which is considerably higher than was to be expected on the basis of a linear relationship from the ratio of the percentages by weight of the components. According to the invention, more particularly the amount of polypropylene is 75 to 85 percent by weight, and preferably 80 percent by weight, and the amount of polyesters and/or polyamides is 25 to 15 percent by weight, and preferably 20 percent by weight. Favorable results are obtained according to the invention if the polyesters and/or polyamides are to a great extent present in the form of fibrils, a large number of the fibrils having a length of at least 0.100 mm, and preferably 0.200 to 5 mm, and a thickness of 0.001 to 0.005 mm. The polyester preferably consists of polyethylene terephthalate and/or polybutylene terephthalate and/or polyhexamethylene terephthalate. As examples of structural units derived from dicarboxylic acids other than terephthalic acids that may be used in the preparation of the polyesters to be used in the formation of the product according to the invention may be mentioned structural units derived from isophthalic acid, diphenyl-p,p'-dicarboxylic acid and naphthalene dicarboxylic acids and the like. As examples of alternative glycols may be mentioned propylene glycol, decamethylene glycol, neopentyl glycol, 1,4-dimethanol cyclohexane and the like.

More particularly, the composite product according the invention is characterized in that of said polyesters and/or polyamides present the melting point is at least 15° C. higher than that of the used polypropylene. The invention also comprises cable or rope composed of one or more bundles or strands which are twisted or laid together and are entirely or partly made up of the composite product provided by the invention.

The composite product according to the invention may be used to advantage for the manufacture of packaging tape, often referred to as strapping.

The invention also provides a process for the manufacture of the above-mentioned composite product, in which process the product is drawn after extrusion, and is characterized in that the drawing operation is carried out in two stages, it often being preferred that the draw ratio in the first stage should be lower than that in the second stage.

According to the invention the draw ratio in the first stage is with advantage not higher than 4 and at least 1.10. According to the invention it is preferred that the total draw ratio should be in the range of 10 to 15. A preferred embodiment according to the invention is characterized in that in the two stages of the drawing operation the elongated-shaped product is subjected to a heat treatment, for instance by means of hot air, the temperature in the second drawing stage being higher than in the first drawing stage. According to the invention the travelling speed of the elongated-shaped product at the beginning of the first drawing stage is with advantage 5 to 20 meters per minute and at the end of the second drawing stage about 50 to 200 meters per minute.

According to the invention, extrusion of the composite product may be carried out by passing the polymer mixture through a screw extruder which is at its discharge end provided with a pin-type mixer. A practical embodiment of the process according to the invention is characterized in that after the polymer mixture has emerged from the screw extruder it is passed through a mixer of the type without moving parts, in which the polymer stream is repeatedly divided, particularly doubled, into a multi-layer stream. Advantageously, the extruded product is cooled by means of air or is passed through a cooling bath or deposited on a cooling roll, with which it is forced into contact by means of an air stream under superatmospheric pressure.

The invention will be further described with reference to the accompanying schematic drawing.

Figure 1:
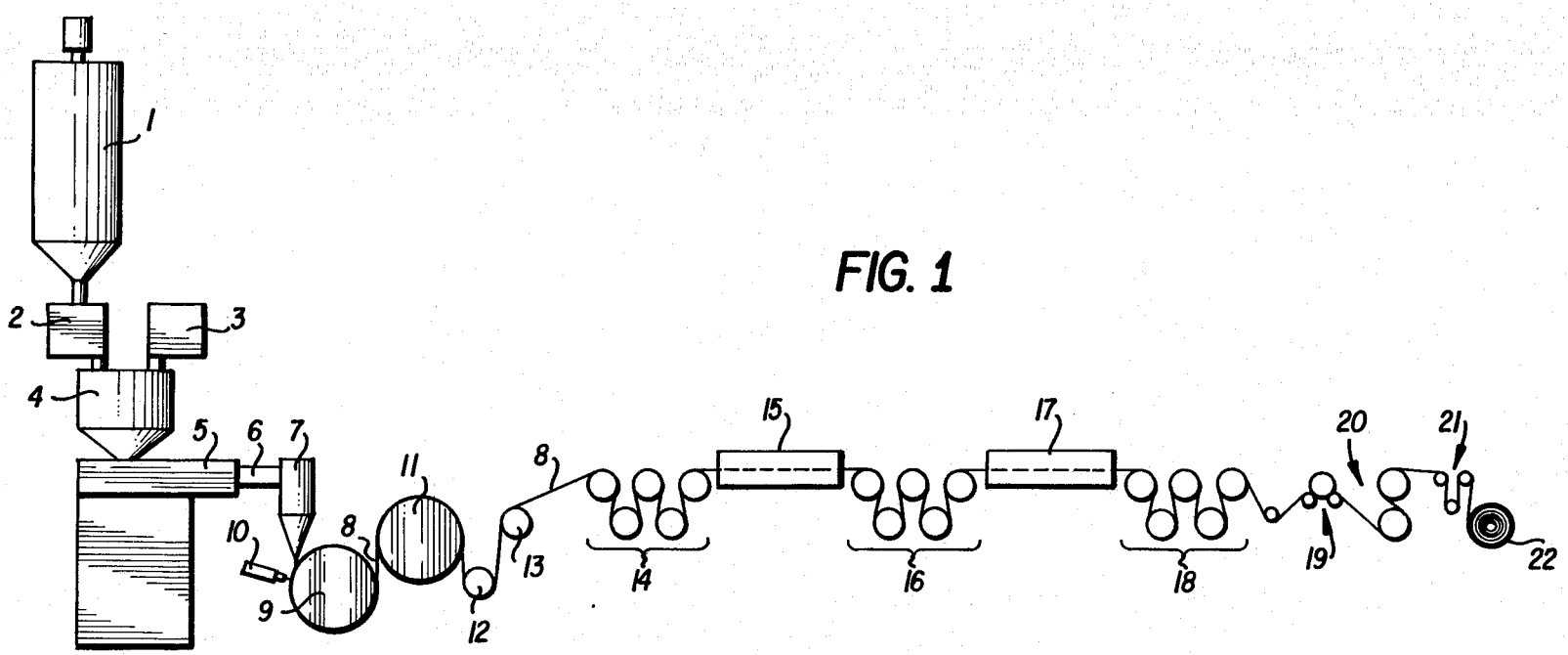
FIG. 1 is a schematic representation of an apparatus for the manufacture of the composite product according to the invention.

From the granulate dryer 1 granules prepared from the polycondensation polymer: polyethylene terephthalate are fed to the supply tank 2. In the supply tank 3 are granules prepared from the polyaddition polymer: polypropylene. From the tanks 2 and 3 the granules are fed into the mixing hopper 4 in the proper weight ratio and from there they are fed into the screw extruder 5. The extruder is of the type described in the German Patent Specification 20 30 756, a pin-type mixer being provided at the discharge end of the screw extruder 5. At the discharge end of the pin-type mixer there may optionally be provided a screen pack, which mainly consists of a number of screens having different mesh sizes. Past the screen pack and downstream of the screw extruder 5 is a mixer 6 of the type without moving parts, as described in the U.S. Pat. No. 3,051,453. In this mixer 6, the two polymer components polypropylene and polyethylene terephthalate which are insoluble one within the other or at least poorly compatible are again homogenized and distributed as a result of the polymer stream being divided into a multi-layer stream. A multi-flux mixer 6 may, for instance, be composed of 16 guide members. Downstream of the mixer or distributor 6 is a flat sheet die 7, out of the extrusion slit of which there is forced a polymer tape 8 having a width of 50 mm. The tape 8 is cooled on the cooling roll 9. The tape 8 is forced into contact with the cooling roll by an air stream from an air knife 10. After passing over the tempering roll 11 and a few guide rolls 12 and 13 the tape 8 will enter a first roller group 14. The tape 8 subsequently passes through a hot-air box 15, a second roller group 16, a second hot-air box 17 and a third, driven roller group 18. The hot-air box 15 forms the first drawing zone or drawing stage and the hot-air box 17 forms the second drawing zone or stage. The difference in speed between the roller groups 14 and 16 makes it possible to set the desired draw ratio in the first drawing stage. The difference in speed between the roller groups 16 and 18 makes it possible to set the desired draw ratio in the second drawing stage. The total draw ratio of the tape 8 is determined by the difference in speed between the roller groups 18 and 14. Subsequently, the drawn, composite product according to the invention passes over a needle roll 19 of a type known per se, as a result of which the drawn tape is formed into split-fibers. Finally, the composite product in the form of split-fibers passes over the roller groups 20 and 21 and is wound into a package 22. The manufacture of split-fibers is merely one example of making the composite product according to the invention. When the fibrillating roll 19 is left out, the end product is a practically non-fibrillated composite product in the form of a tape. Depending on the dimensions, and particularly the thickness, of the non-fibrillated ribbon one will obtain a packaging tape, which is often referred to as strapping. Depending on the construction of the extruder die, it is also possible to produce a single, relatively thick thread, a so-called monofilament.

Another alternative consists in that when the apparatus schematically shown in FIG. 1 is provided with a suitably constructed extruder die, a, for instance, 100 cm-wide sheet material can be manufactured.

It should be noted that by condensation polymers are to be understood polymers formed in polymerization reactions in which simple compounds such as water, hydrochloric acid or ammonia are split off. Such a condensation polymerization should be clearly distinguished from addition polymerization in which no substance is split off. Polypropylene, which forms the largest percentage by weight of the composite product according to the invention, is a polyaddition polymer, i.e. a polymer obtained by addition polymerization. Besides polypropylene the composite product according to the invention contains one or more polyesters and/or polyamides belonging to the group of condensation polymers, i.e. polymers obtained by condensation polymerization.

The invention will be further described on the basis of a number of examples, the results of which are listed in the following tables.

TABLE I

Material: 75% by weight of polypropylene and 25% by weight of polyethylene terephthalate; drawing: in two stages; end-product: split-fiber.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 1.95 | 12.0 | 125 | 140 | 133 | 69.5 | 56.5 | 1.23 |
| 2 | 2.5 | 12.0 | 125 | 140 | 128 | 74 | 57 | 1.30 |
| 3 | 3.0 | 12.0 | 125 | 140 | 133 | 66.2 | 58 | 1.14 |
| 4 | 2.12 | 13.0 | 125 | 140 | 122 | 69.5 | 60 | 1.16 |

wherein:

$S_1$ = draw ratio in the first drawing stage $S_{tot}$ = total draw ratio $T_1$ = air temperature in °C. in the first drawing zone $T_2$ = air temperature in °C. in the second drawing zone In the following tables $S_1$, $S_{tot}$, $T_1$ and $T_2$ have the same meaning.

TABLE II

Material: 80% by weight of polypropylene and 20% by weight of polyethylene terephthalate; drawing: in two stages; end-product: split-fiber.

| Run No | $S_1$ | $S_{tot}$ | $T_1$ | $T_2$ | yarn count in tex | Y tenacity cN/tex test mat. acc. to invention | X tenacity 100% polyprop. Cn/tex (comp.) | $\frac{Y}{X}$ |
|---|---|---|---|---|---|---|---|---|
| 1 | 2.0 | 10.0 | 105 | 140 | 122 | 70 | 52 | 1.35 |
| 2 | 2.5 | 10.0 | 105 | 140 | 122 | 64.2 | 53 | 1.21 |
| 3 | 3.0 | 10.0 | 105 | 140 | 122 | 63.1 | 55.2 | 1.14 |
| 4 | 1.66 | 10.0 | 105 | 140 | 122 | 71 | 51.7 | 1.37 |
| 5 | 1.77 | 11.0 | 105 | 140 | 116 | 76.4 | 54.4 | 1.40 |
| 6 | 2.0 | 11.0 | 105 | 140 | 116 | 76 | 53 | 1.43 |
| 7 | 2.5 | 11.0 | 105 | 140 | 116 | 70.5 | 54.9 | 1.28 |
| 8 | 1.87 | 11.5 | 105 | 140 | 108 | 74.5 | 56.7 | 1.31 |

TABLE III

Material: 85% by weight of polypropylene and 15% by weight of polyethylene terephthalate; drawing: in two stages; end product: split-fiber.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 3.0 | 11.0 | 115 | 140 | 128 | 64.2 | 58.4 | 1.10 |
| 2 | 1.95 | 12.0 | 115 | 140 | 117 | 65 | 56.7 | 1.15 |
| 3 | 2.5 | 12.0 | 115 | 140 | 117 | 64 | 57 | 1.12 |
| 4 | 3.0 | 12.0 | 115 | 140 | 117 | 64.2 | 58 | 1.11 |

TABLE IV

Material: 90% by weight of polypropylene and 10% by weight of polyethylene terephthalate; drawing: in two stages; end product: split-fiber.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 1.95 | 12.0 | 105 | 150 | 128 | 72 | 57 | 1.26 |
| 2 | 2.50 | 12.0 | 105 | 150 | 128 | 66.3 | 57 | 1.16 |
| 3 | 3.0 | 12.0 | 105 | 150 | 128 | 68 | 58 | 1.17 |
| 4 | 2.12 | 13.0 | 105 | 150 | 117 | 72 | 60.7 | 1.19 |
| 5 | 2.5 | 13.0 | 105 | 150 | 117 | 69 | 60.3 | 1.14 |

TABLE V

Material: 80% by weight of polypropylene and 20% by weight of polyamide 6; drawing: in two stages; end product: split-fiber.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 2.0 | 9.0 | 102 | 125 | 184 | 65.5 | 49.5 | 1.32 |
| 2 | 2.0 | 10.0 | 102 | 125 | 172 | 66 | 51 | 1.29 |
| 3 | 2.5 | 10.0 | 102 | 125 | 178 | 63 | 51.8 | 1.22 |

TABLE VI

Material: 80% by weight of polypropylene and 20% by weight of polyethylene terephthalate; drawing: in two stages; end product: strapping.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 1.7 | 10.0 | 100 | 155 | 5550 | 48 | 35 | 1.37 |
| 2 | 2.5 | 10.5 | 100 | 155 | 5550 | 45 | 38 | 1.18 |
| 3 | 2.0 | 10.5 | 100 | 155 | 5550 | 57 | 40 | 1.47 |

TABLE VII

Material: 80% by weight of polypropylene and 20% by weight of polyethylene terephthalate; drawing: in two stages; end product: monofilament.

| Run No | $S_1$ | $S_{tot}$ | $T_1$ | $T_2$ | yarn count in tex | Y tenacity cN/tex test mat. acc. to invention | X tenacity 100% polyprop. cN/tex (comp.) | $\frac{Y}{X}$ |
|---|---|---|---|---|---|---|---|---|
| 1 | 1.14 | 9.5 | 98 | 132 | 42.2 | 67.5 | 58.5 | 1.15 |
| 2 | 1.53 | 11.8 | 98 | 132 | 30 | 76.5 | 65 | 1.18 |
| 3 | 1.57 | 11.0 | 98 | 132 | 30 | 77 | 64 | 1.20 |
| 4 | 1.56 | 11.1 | 98 | 132 | 32.3 | 79 | 65.5 | 1.21 |
| 5 | 1.55 | 11.0 | 98 | 132 | 31 | 77 | 64 | 1.20 |
| 6 | 1.55 | 11.0 | 98 | 140 | 11.1 | 78 | 66.5 | 1.17 |
| 7 | 1.55 | 11.0 | 98 | 140 | 14.5 | 63 | 54 | 1.17 |
| 8 | 1.8 | 11.0 | 98 | 140 | 13.8 | 76.5 | 65 | 1.18 |
| 9 | 1.4 | 11.0 | 98 | 140 | 18.9 | 65 | 57.6 | 1.13 |
| 10 | 1.2 | 11.0 | 98 | 140 | 21 | 67.5 | 58.5 | 1.17 |
| 11 | 1.2 | 11.0 | 98 | 140 | 20.5 | 67.5 | 56.7 | 1.19 |
| 12 | 1.2 | 11.0 | 98 | 140 | 16.7 | 79 | 54 | 1.46 |
| 13 | 1.2 | 11.0 | 98 | 140 | 21.6 | 68.5 | 55.8 | 1.23 |
| 14 | 3.87 | 11.0 | 98 | 140 | 33.8 | 66.5 | 53 | 1.19 |
| 15 | 1.28 | 11.0 | 98 | 140 | 42.2 | 65 | 51 | 1.27 |
| 16 | 3.8 | 11.0 | 98 | 140 | 40 | 67.5 | 53 | 1.27 |
| 17 | 3.8 | 11.0 | 98 | 140 | 46.7 | 64 | 51 | 1.25 |
| 18 | 1.23 | 11.0 | 98 | 140 | 51 | 65.5 | 54 | 1.21 |
| 19 | 1.55 | 11.0 | 98 | 150 | 21.6 | 69 | 58.5 | 1.18 |
| 20 | 1.55 | 12.0 | 98 | 150 | 24.5 | 66.5 | 57.6 | 1.15 |
| 21 | 1.55 | 10.0 | 98 | 150 | 22.8 | 64 | 50.4 | 1.27 |
| 22 | 1.55 | 10.0 | 98 | 130 | 17.2 | 73 | 63 | 1.16 |
| 23 | 1.55 | 11.0 | 98 | 130 | 17.8 | 72 | 60 | 1.20 |

The test results listed in the Tables I–V were obtained for composite products according to the invention formed into split-fiber by means of an apparatus of the type shown in FIG. 1.

The tenacities Y and X were determined in accordance with DIN 53816 on an Instron tester at a tensile rate of 100% per minute.

In the tensile test the free length between grips was 250 mm, and the test material was given a twist of 80 turns per meter. For other yarn counts a usual twist must be chosen which has the same value for determining the tenacities Y and X. As mentioned before, the tenacity X was determined on a practically 100%-polypropylene split-fiber. This purely propylene split-fiber was made in the same way as the composite product according to the invention.

Of the 100%-polypropylene split-fiber the melt index is 3, by which is meant the melt index determined in conformity with British Standard 2782:105 C.

Both the composite product according to the invention and the control product of pure propylene were prepared from polypropylene in the form of granules of the type usual for extrusion (extrusion grade).

Figure 2:
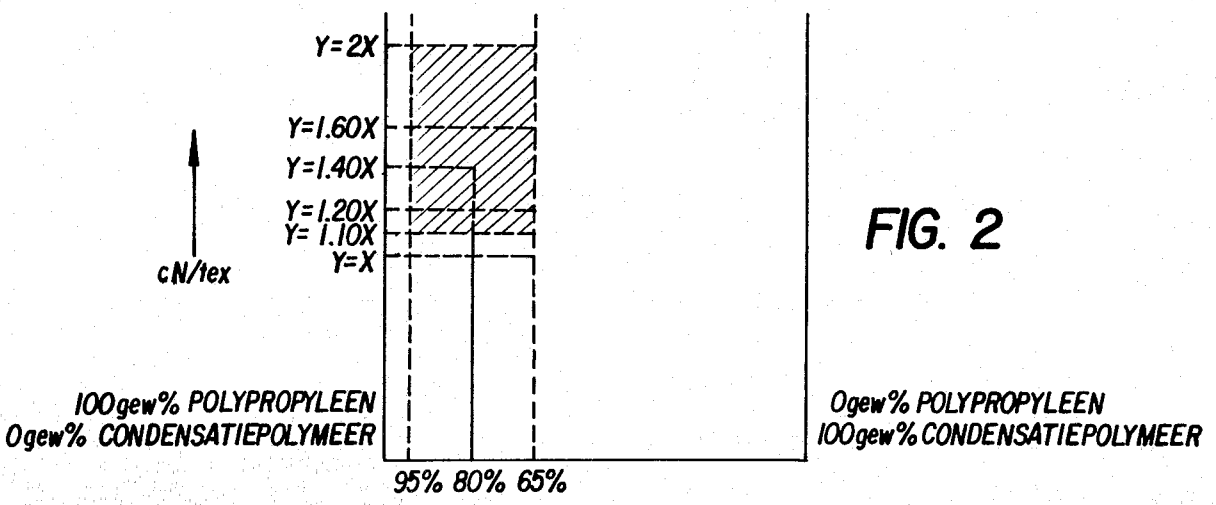
FIG. 2 is a diagram indicating mixing ratio and tensile strength.

In FIG. 2 the weight percentages are plotted on the horizontal axis in such a way that the point at the extreme left represents 100 percent by weight of polypropylene and 0 percent by weight of said condensation polymers, for instance: polyethylene terephthalate. The point at the extreme right of the horizontal axis represents 0 percent by weight of polypropylene and 100 percent by weight of said condensation polymers, for instance: polyethylene terephthalate. The tenacity in cN/tex is plotted on the vertical axis, X representing the tenacity in cN/tex of a product which is a practically 100% percent by weight polypropylene.

Since the composite product according to the invention has a tenacity Y which is higher than the value $Y=1.10X$ and contains 65 to 95% polypropylene, the tenacity Y of the composite product according to the invention is in between the vertical 65% and 95% lines and above the horizontal line $Y=1.10X$ given in FIG. 2.

A particularly favorable composite product according to the invention contains 80 percent by weight of polypropylene and 20 percent by weight of polyethylene terephthalate. The tenacity Y of this composite product was found to be about 40% higher than that of the practically 100% polypropylene split-fiber. In FIG. 2 the strength of the composite product can be found on the vertical line for 80 percent by weight of polypropylene and a length $Y=1.40X$.

In the case where the composite product according to the invention is not formed of split-fiber, but threads, ribbon-or-film-shaped product, the tensile strength of the composite product according to the invention is also found to have a value of at least $Y=1.10X$. In the preceding text mention is made a few times of a corresponding elongated-shaped practically 100% polypropylene product. By corresponding is meant that the composite product according to the invention is thread-shaped, i.e. it consists of monofilament, in which case the strength X is also measured on a 100% polypropylene monofilament, which monofilament has been made in entirely the same way as the monofilament according to the invention.

If for instance the composite elongated-shaped product according to the invention is formed by strapping consisting of 80 percent by weight of polypropylene and 20 percent by weight of polyethylene terephthalate, then the strength X must be also measured on 100% polypropylene products in the form of strapping and made in the same way as the composite product in the form of strapping according to the invention. When in a different example the composite product according to the invention is formed as a ribbon, which may for instance be used for making carpet backing, having a tensile strength Y and consisting of 70 percent by weight of polypropylene, 5 percent by weight of polybutylene terephthalate, 5 percent by weight of polyethylene terephthalate and 20 percent by weight of polyamide 6, then the tensile strength X must again be measured on a corresponding product, i.e. on ribbon manufactured in the same way of 100%-polypropylene.

It should be added that of products which instead of being split-fiber threads, ribbon or film, the tensile strength Y of the composite product according to the invention and the tensile strength X are also determined in accordance with DIN 53816 on an Instron tester in the usual way at a tensile rate of 100% per minute, the free length between the grips being 250 mm.

As mentioned before, the composite product provided by the invention contains one or more of said polycondensation polymers as well as the polyaddition polymer polypropylene. For instance, instead of one polycondensation polymer the composite product according to the invention may contain two or three of the different polycondensation polymers mentioned. In addition to 80 percent by weight of polypropylene the composite product according to the invention may contain 10 percent by weight of polyethylene terephthalate and 10 percent by weight of polyamide in the form of nylon 6 or 66. Alternatively, the composite product according to the invention may for instance contain 80 percent by weight of polypropylene and 5 percent by weight of polybutylene terephthalate, 5 percent by weight of polyethylene terephthalate and 10 percent by weight of polyamide in the form of polyamide 6 or 66.

It should be added that the apparatus for the manufacture of the monofilament mainly differs from the apparatus according to FIG. 1 only in that the product obtained after extrusion is cooled in a water tank.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A split-fiber rope composed of at least one helically extending bundle of threads, said threads consisting of a composite elongated product comprising at least two synthetic polymer components, one of the polymer components being present in an amount of from 75 to 85% by weight of polypropylene and the second polymer component in an amount of from 25 to 15% by weight, based on the total weight of the composite product, of a polyester substantially formed of polyethylene terephthalate having a melting point which is at least 15 Centigrade degrees higher than the melting point of said polypropylene, said polyester being distributed in the polypropylene with at least a part thereof being in the form of fibrils, a large number of the fibrils having a length of at least 0.1 mm and a thickness of not more than 0.005 mm, said composite elongated product having been drawn in at least two stages, the draw ratio in the first stage not being higher than 4 and the total draw ratio not being higher than 14, which composite elongated product is present in the rope substantially in the form of split fibers and in its oriented state having a tensile strength of 1.2 times to 2 times the tensile strength of a practically 100 percent polypropylene product having a melt index of 3 and a tensile strength of at least 45 cN/tex and made in the same way as the said composite elongated product.

2. A rope as defined in claim 1 wherein the polyethylene terephthalate is present in an amount of substantially 20% by weight, based on the total weight of the composite elongated product.

3. A rope as defined in claim 1 wherein, in its oriented state, the composite elongated product has a tensile strength of at least 1.2 to 1.6 times the value of 45 cN/tex.

4. A rope as defined in claim 1 wherein, in its oriented state, the composite elongated product has a tensile strength of 1.2 times to 1.6 times the tensile strength of an otherwise similar rope made from a practically 100% polypropylene having a melt index of 3 and made in the same way as the said composite elongated product.

* * * * *